United States Patent [19]

Bunning et al.

[11] Patent Number: 4,685,235

[45] Date of Patent: Aug. 11, 1987

[54] BARREL ALIGNMENT DEVICE IN AUTOMATIC WEAPON

[75] Inventors: Ernst Bunning, Durham, N.H.; Wayne Hutchins, Sanford, Me.

[73] Assignee: Maremont Corporation, Carol Stream, Ill.

[21] Appl. No.: 904,859

[22] Filed: Sep. 8, 1986

Related U.S. Application Data

[63] Continuation of Ser. No. 593,593, Mar. 26, 1984, abandoned.

[51] Int. Cl.[4] ..... F41C 21/22

[52] U.S. Cl. ..... 42/75.02; 42/77; 89/14.05

[58] Field of Search ..... 42/75.02, 77; 89/14.05

[56] References Cited

U.S. PATENT DOCUMENTS

| | | | |
|---|---|---|---|
| 2,345,127 | 3/1944 | Kehne | 42/75 |
| 2,353,885 | 7/1944 | Fanger et al. | 42/75 |
| 2,789,478 | 4/1957 | McColl | 89/163 |
| 2,852,880 | 9/1958 | Kauffman | 42/75 B |
| 2,981,154 | 4/1961 | Sweeney | 89/14 |
| 2,987,966 | 6/1961 | Meyer | 89/14 |

*Primary Examiner*—Deborah L. Kyle
*Assistant Examiner*—Ted L. Parr
*Attorney, Agent, or Firm*—Allegretti, Newitt, Witcoff & McAndrews, Ltd.

[57] ABSTRACT

An improvement alignment device in an automatic weapon comprises a boss on the weapon barrel and an aligned entry slot, crossover slot and retention slot in the barrel support.

8 Claims, 9 Drawing Figures

10
12
13
14
16
18
20
22
24
26
28
32
34
35
4

BARREL ALIGNMENT DEVICE IN AUTOMATIC WEAPON

This application is a continuation of application Ser. No. 593,593, filed Mar. 26, 1984, now abandoned.

BACKGROUND OF THE INVENTION

This invention relates to firearms, and more particularly to stock and barrel fastenings for firearms.

Firearms such as automatic weapons have long been made with barrels detachable from their stocks. Fastenings for such barrels and stocks have typically included interrupted lugs, also called bayonet catches or teeth, on the barrels and stocks. The lugs are interrupted in that they include two, three or more circumferential segments separated from each other by interposed spaces. The lugs and spaces cooperate such that the barrels and stocks may be attached by sliding the lugs in the slots and then twisting the barrels and stocks to engage the lugs of the barrels and stocks with each other.

Since the beginning of use of such lugs, aids or guides have been included in firearms to provide for rapid, sure use of gthe lugs and rapid, sure attachment and detachment of firearm parts. All the various guides have suffered from the disadvantages of complexity, inadequacy, difficulty of use, the addition of weight to the weapon, or the like.

SUMMARY OF THE INVENTION

An object of the inventors in making this invention was to triumph where the prior art had failed, and provide a guide for truly rapid, sure attachment and detachment of a firearm (more precisely, a machine gun or automatic weapon) barrel and stock.

Objects were to provide a guide visually observable by the firearm operator, and a guide which minimally added to firearm weight and avoided weakness in firearm part strength.

These objects are met by the invention, which is, in a principal aspect, an improved alignment device in an automatic weapon. The weapon has a barrel, a barrel extension, and a barrel support. The barrel and extension have cooperating, interrupted lugs with interposed spaces. The improved alignment guide comprises a boss on the barrel, and means on the barrel support for forming a plurality of alignment slots in the barrel support. The slots are adapted to receive the boss, and are aligned with the interrupted lugs. The slots include an entry slot, a crossover slot and a retention slot.

A more formal, precise description of the invention of this specification is provided by the claims, which conclude this specification, and a more detailed exposition of the features, objects and advantages of the invention is provided by the detailed description of the preferred embodiment, which folows.

DETAILED DESCRIPTION OF THE PREFERRED EMBODIMENT

Figures 1, 2, 3, 4:
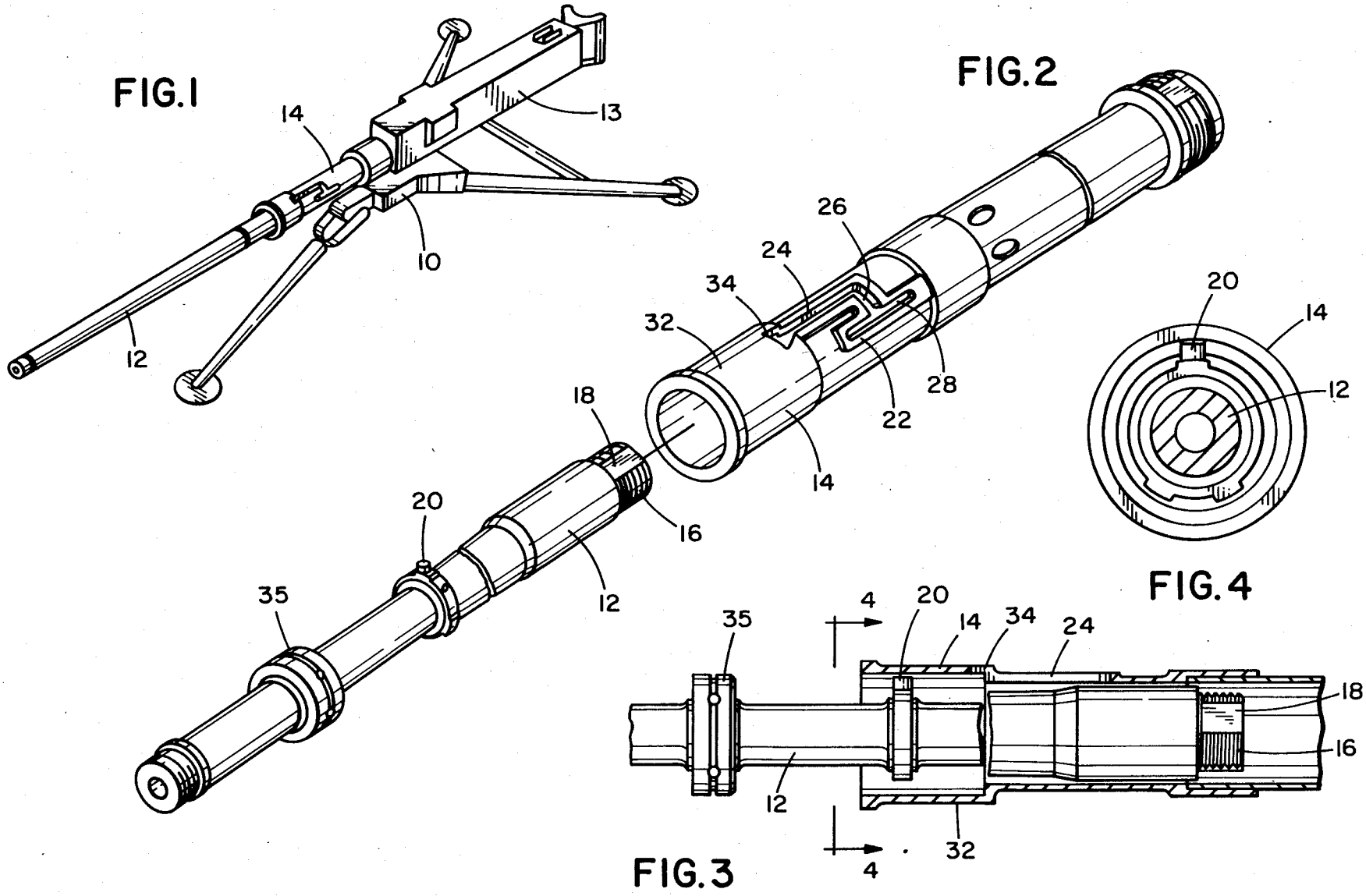
FIG. 1 is an artist's perspective view of a preferred automatic weapon incorporating the invention.
FIG. 2 is a perspective view of the barrel and barrel support of the preferred embodiment of FIG. 1 with the barrel and barrel support separated from each other and abbreviated in length.
FIG. 3 is a side view of the barrel and a portion of the barrel support of FIGS. 1 and 2, during insertion of the barrel, with the barrel again abbreviated in length and with the portion of the barrel support in longitudinal, central cross-section.
FIG. 4 is a transverse cross-section view of the barrel and an end view of the barrel support, taken along line 4—4 of FIG. 3.
Figure 5:
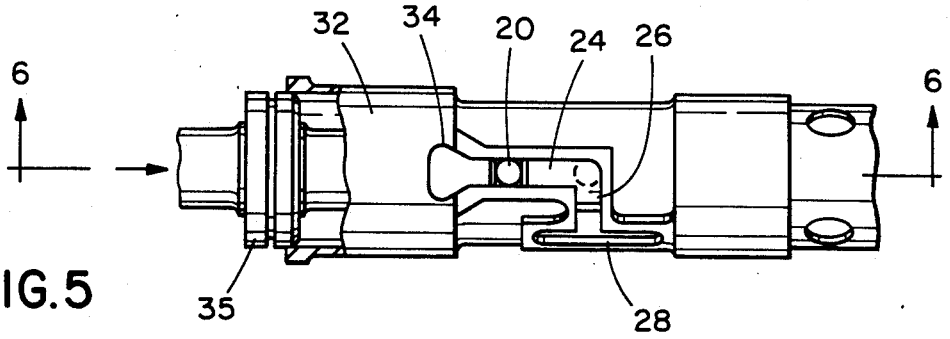
FIG. 5 is a top or plan view of portions of the barrel and barrel support during further barrel insertion.
Figure 6:
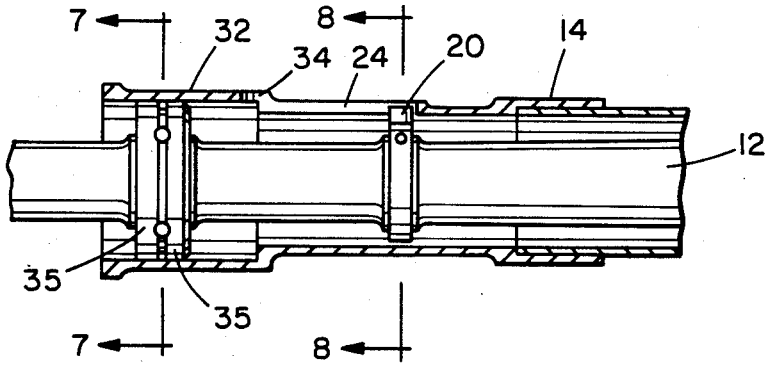
FIG. 6 is a side view similar to FIG. 3, taken along line 6—6 of FIG. 5.
Figure 7:
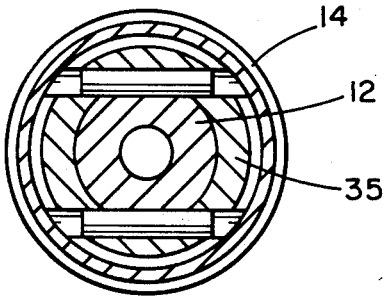
FIG. 7 is a cross-section view taken along line 7—7 of FIG. 6.

Referring to FIG. 1, the preferred embodiment of the invention is an improvement in an automatic weapon such as machine gun 10. A barrel 12 of the gun 10 is received, supported and guided at its outer end by a stationary barrel support 14. As shown in FIGS. 2 and 3, the barrel 12 has interruped lugs 16 with interposed spaces 18 at its inner end. A reciprocating barrel extension (not shown) within the gun body 13 has cooperating lugs and spaces. The lugs and spaces are cooperatively sized, shaped and arranged such that (a) the lugs of the barrel may be slid in the slots of the barrel extension, and vice versa, and (b) the lugs of the barrel and barrel extension may be meshed to lock the barrel to the extension by twisting of the barrel. The barrel and extension may then reciprocate together, while the support remains stationary.

Figure 8:
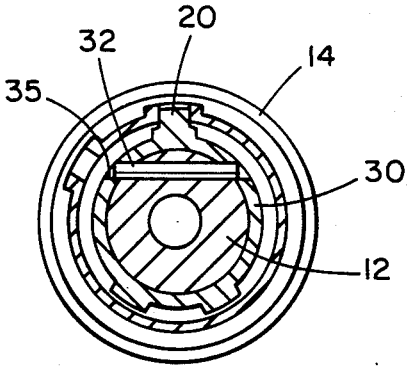
FIG. 8 is a cross-section view taken along line 8—8 of FIG. 6.
Figure 9:
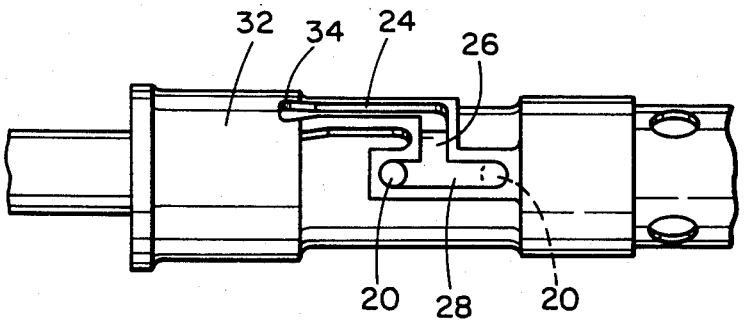
FIG. 9 is a view of portions of the barrel and barrel support, generally from the side, with the top of the barrel and barrel support rotated slightly downward.

The improvement is an alignment device including a boss 20 on the barrel 12, and a portion 22 of the support 14 defining a plurality of slots 24, 26, 28. The boss 20 is a cylindrical protuberance which is part of a ring 30, shown in FIG. 8. The ring 30 is pinned by a pin 32 in a channel 33 to the barrel 12. The slots 24, 26, 28 are an entry slot 24, a crossover slot 26, and a retention slot 28.

An enlarged or belled portion 32 of the barrel support 14 defines the end of the barrel support. The portion 32 is adjacent the portion 22. As shown in FIG. 3, the belled portion 32 has an interior diameter greater than twice the maximum radius of the barrel at the boss 20, such that the boss and barrel enter the portion 32 without interference. The portion 32 supports the barrel 12 by supporting the guide ring 35.

A funneling lead 34 of the entry slot 26 begins in the barrel support portion 32. The lead 34 tapers into the entry slot 24, which extends longitudinally along the top of the barrel support. The entry slot 24 has a width substantially equal to the diameter of the boss 20.

The entry lot 24 merges with the crossover slot 26 at the end of the entry slot remote from the lead 34. The crossover slot 26 extends transversely, i.e., circumferentially, about the barrel support 14 for substantially the width of the interrupted lugs 16. The slot 26 also has a width substantially equal to the diameter of the boss 20.

The crossover slot 26 merges with the retention slot 28 opposite the end which merges with the entry slot 24. The retention slot 28 has the same width, and extends longitudinally. The crossover lot intersects, i.e., merges near the middle of, the slot 28.

The retention slot 28 has a length suitable to allowing reciprocation of the boss 20 in the slot 28 as the barrel reciprocates relative to the support 14. Because of the location of intersection of the slots 26, 28, and the speed of reciprocation, the boss 20 does not enter the slot 26 during reciprocation.

The slots 24, 26, 28 are located on the barrel support 14, the boss 20 is located on the barrel 12, and the lugs are located on barrel and barrel extension for rapid, sure meshing of the lugs. With the boss 20 entering the entry slot 24, the lugs are moving into the spaces interposed between the opposite lugs. When the boss 20 reaches the juncture of the slots 24, 26, the lugs are positioned to easily be meshed by twisting of the barrel, with the boss 20 in the slot 26 controlling the angle of the twisting. With the boss 20 in the slot 28, the lugs are fully meshed.

Thus, the slots and boss are aligned with the lugs. The entry slot and boss are aligned with the lugs such that upon movement of the barrel into assembled position with the barrel extension, the boss enters the entry slot with the lugs on the barrel aligned with the interposed spaces on the barrel extension, and vice versa. The crossover slot is aligned relative to the lugs such that movement of the boss in the crossover slot causes facile cooperation of the lugs. The barrel can be rapidly, surely attached and detached from the weapon.

The preferred embodiment of the invention is now described. This preferred embodiment constitutes the best mode contemplated by the inventors of carrying out the invention. The invention, and the manner and process of making and using it, have been described in full, clear, concise and exact terms to enable any person skilled in the art to make and use the same. Because the invention may be copied without the copying of the precise details of the preferred embodiment, the following claims particularly point out and distinctly claim the subject matter which the inventors regard as their invention and wish to protect.

What is claimed is:

1. In an automatic weapon, the weapon having a barrel, barrel extension and a barrel support, the barrel and barrel extension having cooperating interrupted lugs and interposed spaces, the improvement of an alignment device comprising a boss on the barrel and means on the barrel support for forming a plurality of alignment slots in the barrel support adapted to receive the boss, the alignment slots including an entry slot, a crossover slot and a retention slot, the crossover slot merging with the entry slot and the retention slot merging with the crossover slot, the retention slot being aligned substantially along the length of the barrel support and having forward and rear ends, the crossover slot being substantially perpendicular to the retention slot and intersecting the retention slot intermediate the forward and rear ends of the retention slot such that the boss may reciprocate in the retention slot past the crossover slot, the entry slot and boss being aligned in relation to the interrupted lugs such that upon movement of the barrel into assembled positin with the barrel extension, the boss enters the entry slot with the interrupted lugs on the barrel aligned with the interposed spaces on the barrel extension and vice versa, the crossover slot and boss being aligned in relation to the interrupted lugs such that movement of the boss in the crossover slot causes facile cooperation of the interrupted lugs, and the retention slot and boss being aligned in relation to the interrupted lugs such that the boss may reciprocate in the retention slot while the interrupted lugs cooperate to attach the barrel to the barrel extension.

2. An improvement as in claim 1 in which the barrel support has an exterior and the alignment slots are all visible from the exterior of the barrel support, and in which the boss while in the alignment slots is also visible from the exterior of the barrel support.

3. An improvement as in claim 2 in which the boss while in the alignment slots is always visible from the exterior of the barrel support.

4. An improvement as in claim 1 in which the boss is a fixed boss affixed to the barrel.

5. In an automatic weapon, the weapon having a barrel, barrel extension and a barrel support, the barrel and barrel extension having cooperating interruped lugs and interposed spaces, the barrel and barrel support having an alignment device comprising a boss and means for forming a plurality of alignment slots adapted to receive the boss, the alignment slots including an entry slot, a crossover slot and a retention slot, the crossover slot merging with the entry slot and the retention slot merging with the crossover slot, the entry slot and boss being aligned in relation to the interrupted lugs such that upon movement of the barrel into assembled position with the barrel extension, the boss enters the entry slot with the interrupted lugs on the barrel aligned with the interposed spaces on the barrel extension and vice versa, the crossover slot and boss being aligned in relation to the interrupted lugs such that movement of the boss in the crossover slot causes facile cooperation of the interrupted lugs, and the retention slot and boss being aligned in relation to the interrupted lugs such that the boss may reciprocate in the retention slot while the interrupted lugs cooperate to attach the barrel to the barrel extension, the improvement of the boss being on the barrel and the means for forming the plurality of alignment slots being means on the barrel support for forming the plurality of alignment slots in the barrel support, the retention slot being aligned substantially along the length of the barrel support and having forward and rear ends, and the crossover slot being substantially perpendicular to the retention slot and intersecting the retention slot intermediate the forward and rear ends of the retnetion slot such that the boss may reciprocate in the retention slot past the crossover slot.

6. An improvement as in claim 5 in which the barrel support has an exterior and the alignment slot are all visible from the exterior of the barrel support, and in which the boss while in the alignment slots is also visible from the exterior of the barrel support.

7. An improvement as in claim 5 in which the boss while in the alignment slots is always visible from the exterior of the barrel support.

8. An improvement as in claim 5 in which the boss is a fixed boss affixed to the barrel.

* * * * *

UNITED STATES PATENT AND TRADEMARK OFFICE

CERTIFICATE OF CORRECTION

PATENT NO. : 4,685,235

DATED : August 11, 1987

INVENTOR(S) : Ernst Bunning; Wayne Hutchins

It is certified that error appears in the above-identified patent and that said Letters Patent is hereby corrected as shown below:

In the Claims:

Claim 1, line 62, delete "positin" and insert --position--.

Claim 5, line 21, delete "interruped" and insert --interrupted--.

Claim 5, line 53, delete "retnetion" and insert --retention--.

Signed and Sealed this

Second Day of February, 1988

*Attest:*

DONALD J. QUIGG

*Attesting Officer*

*Commissioner of Patents and Trademarks*